United States Patent [19]

Riezler

[11] Patent Number: 4,951,717

[45] Date of Patent: Aug. 28, 1990

[54] AIR JET WEAVING LOOM WITH AN EXPANDER HAVING AN EXTENSION

[75] Inventor: Rudolf Riezler, Nonnenhorn, Fed. Rep. of Germany

[73] Assignee: Lindauer Dornier Gesellschaft mbH, Lindau, Fed. Rep. of Germany

[21] Appl. No.: 335,032

[22] Filed: Apr. 7, 1989

[30] Foreign Application Priority Data

Apr. 7, 1988 [DE] Fed. Rep. of Germany ..... 3811653

[51] Int. Cl.[5] ..... D03D 47/28

[52] U.S. Cl. ..... 139/435.1

[58] Field of Search ..... 139/291, 292, 294, 295, 139/188 R, 192, 435

[56] References Cited

U.S. PATENT DOCUMENTS 4,116,243 9/1978 Vettiger ..... 139/192

4,478,259 10/1984 Honegger ..... 139/192

FOREIGN PATENT DOCUMENTS 744603 3/1970 Belgium ..... 139/292

*Primary Examiner*—Henry S. Jaudon

*Attorney, Agent, or Firm*—W. G. Fasse; D. H. Kane, Jr.

[57] ABSTRACT

An air jet weaving loom is equipped with an expander table and has a weaving reed forming a weft thread insertion channel. The expander table has an extension reaching toward the channel and preferably to about the center of the channel. The extension has a top surface which forms an elongation of a fabric supporting surface of the expander table. This arrangement assures that the beat-up or interlacing point is always located about centrally in the weft thread insertion channel.

2 Claims, 1 Drawing Sheet

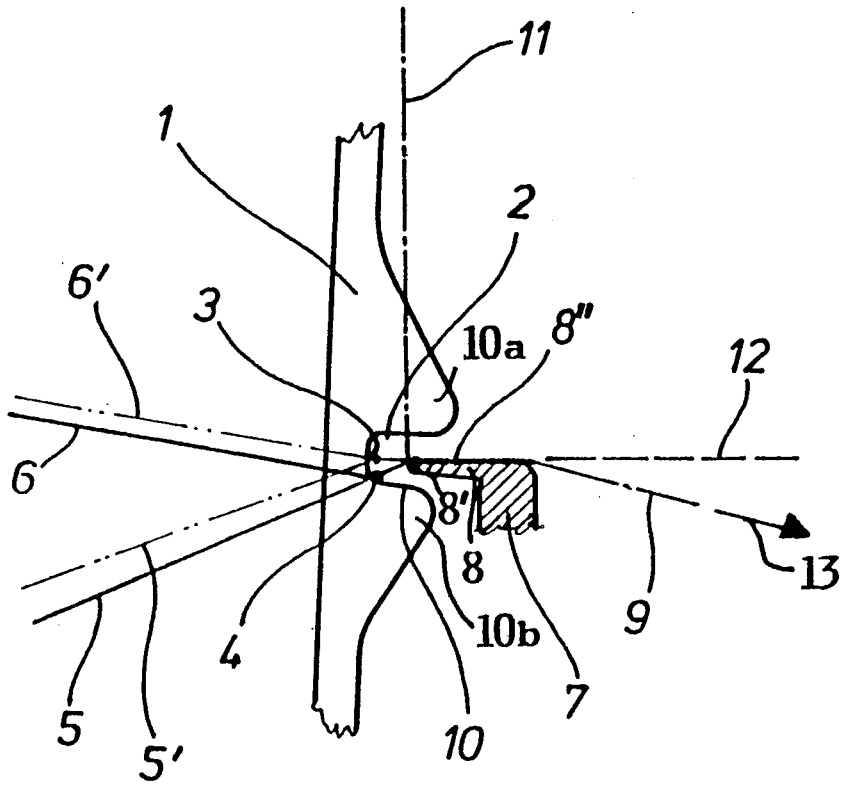
11
1
2
6'
3
10a
8"
12
6
8'
8
13
9
10b
4
7
5
5'
10

AIR JET WEAVING LOOM WITH AN EXPANDER HAVING AN EXTENSION

CROSS-REFERENCE TO RELATED APPLICATION

The present application related to copending application U.S. Ser. No. 07/335,043, filed on the same date, namely Apr. 7, 1989, with the present application, and also entitled: "AIR JET WEAVING LOOM WITH AN EXPANDER HAVING AN EXTENSION".

FIELD OF THE INVENTION

The present application relates to an air jet weaving loom wherein a plurality of reed teeth form a weft thread insertion channel. Such a loom is equipped with an expander table.

BACKGROUND INFORMATION

It is known to arrange an expander table in front of the weaving reed for properly spreading the woven fabric. Conventionally, the expander table does not reach into the weft thread insertion channel. Such a structure has several disadvantages. First, the location of the interlacing or "beat-up" point varies with fabrics of different interlacing or binding numbers, for example, a ¼ type binding or a 4/1 type binding. Conventionally, the interlacing or beat-up point or rather, the weft thread, could travel within the weft thread insertion channel, for example upwardly or downwardly, thereby colliding with an edge of the reed teeth. Such collisions have a tendency to damage the weft thread. Second, another disadvantage is seen in that the beat-up line or interlacing line where the woven fabric begins, contacts the weft thread inserting nozzles spaced along the weft thread insertion channel, whereby again damage can be caused, but this time to the fabric itself.

OBJECTS OF THE INVENTION

In view of the foregoing it is the aim of the invention to achieve the following objects singly or in combination:

to improve an air jet weaving loom having a weaving reed and a spreader table in such a manner that the interlacing line or beat-up line is always located relatively centrally in the middle or center of the weft thread insertion channel independently of the type of fabric being produced;

to avoid the uncontrolled movement of the beat-up or interlacing line that has been encountered heretofore; and to guide the edge of the fabric along the beat-up line away from the reed teeth to avoid damage to the fabric and to the individual weft threads.

SUMMARY OF THE INVENTION

According to the invention there is provided a spreader table equipped with an extension projecting toward the weft thread insertion channel, said extension having a top surface forming an elongation of a fabric supporting surface of the spreader table for positively locating a beat-up or interlacing position of each weft thread, preferably along a center line in the weft thread insertion channel.

The combination of a spreader table with a table extension projecting with its free edge preferably into the center of the weft thread insertion channel, has several advantages. First, the fabric support surface is enlarged so that the fabric is already supported while it is still in the insertion channel, whereby damage to the weft thread and to the fabric as it is being formed along the beat-up line is avoided. Such supporting of the fabric already in the insertion channel is not possible with a conventional spreader table located entirely outside the weft thread insertion channel. The invention avoids the problems of the prior art by centering the beat-up or interlacing line of the fabric in the middle of the weft thread insertion channel, whereby any excursions of the weft thread up or down or sideways within the insertion channel are avoided, regardless of the type of binding or weave texture. For example, with a ¼ type of binding the interlacing or binding point can no longer travel forwardly and downwardly in the insertion channel.

By locating the free edge of the spreader table extension approximately in the center of the weft thread insertion channel both horizontally and vertically, thereby pointing centrally toward the bottom of the weft thread insertion channel, the interlacing or beat-up line is positively defined and is maintained within the weft thread insertion channel so that the reed teeth edges cannot damage the fabric nor the weft thread anymore. More specifically, the finished fabric, or rather its edge along the beat-up line, can now be guided away from the weft thread insertion nozzles by the spreader extension or projection of the spreader table.

BRIEF DESCRIPTION OF THE DRAWING

In order that the invention may be clearly understood, it will now be described, by way of example, with reference to the single FIGURE of the accompanying drawing, showing a side view into the loom shed in the direction of the weft thread insertion and illustrating the spreader table with its extension in a sectional view.

DETAILED DESCRIPTION OF A PREFERRED EXAMPLE EMBODIMENT AND OF THE BEST MODE OF THE INVENTION

The FIGURE shows only one reed tooth 1. Conventionally, a plurality of such teeth 1 form the weaving reed. Each reed tooth 1 has an upper projection **10*a* and a lower projection 10*b* to form a weft thread insertion channel 2. Air jets not shown insert and transport the weft thread through the insertion channel 2 perpendicularly to the plane of the drawing sheet. The finished fabric 9 is withdrawn in the direction of the arrow 13, which may slant downwardly relative to the horizontal 12**.

Dash-dotted lines 5' and 6' indicate the warp threads in an ideal position because the binding or interlacing point 3 is located at or near the bottom center of the insertion channel 2. Such location of the binding or interlacing or beat-up position or point is desirable because it results in a high quality fabric 9. On the other hand, the full lines 5 and 6 represent warp threads which merge in an interlacing or beat-up point 4 on the upwardly facing edge 10 of the lower projection **10*b***. This is undesirable because it leads to a marred fabric and also to interrupted or damaged weft threads.

In order to avoid the problem of displaced beat-up or interlacing points or lines, the invention uses a modified expander table 7 having an upper fabric supporting and spreading surface 7'. According to the invention the expander table 7 has an extension 8 with a free or straight edge 8'and a top surface 8''. The free or straight edge 8' reaches toward the weft thread insertion channel 2 and preferably approximately into the center of the channel 2. In any event, the surface 8'' forms an elongation of the surface 7', whereby an improved spreading and guiding of the fabric 9 is achieved due to the enlarged guide surface.

The extension 8 with its top surface 8'' extends substantially horizontally and merges horizontally into the fabric support surface 7'. The surface 7' then may curve slightly downwardly for an effective spreading of the fabric 9.

By extending the free or straight edge 8' of the spreader table extension 8 all the way to the center of the insertion channel 2, the invention makes sure that the weft thread cannot travel in an uncontrolled manner, whereby the weft thread is positively located and the beat-up or interlacing position of each weft thread remains constant substantially in an ideal location at or near the interlacing point 3 and an undesirable interlacing or beat-up point 4 is avoided. As a result, the fabric is not contacted by the weft insertion air nozzles and the weft thread cannot be damaged or cut by the edge 10.

The center of the insertion channel 2 is located approximately at an intersection of the middle of a vertical height line 11 through the middle of a horizontal depth line of the weft thread insertion channel. The depth of the insertion channel 2 is measured horizontally from the tip of the longest projection 10*a* to the bottom of the channel 2. Although the invention has been described with reference to specific example embodiments, it will be appreciated that it is intended to cover all modifications and equivalents within the scope of the appended claims.

What I claim is:

1. An air jet weaving loom, comprising a weaving reed including reed teeth forming a weft thread insertion channel, an expander table arranged alongside said weaving reed to face said weft thread insertion channel, said expander table having a table surface for supporting a fabric to keep said fabric spread, said expander table having an extension projecting toward said weft thread insertion channel, said extension having a free straight edge (8') facing in a direction substantially opposite to a fabric withdrawal direction, said extension further having a flat top surface (8'') forming an elongation of said table surface (7'), so that said table surface terminates in said free straight edge (8') reaching approximately to the center of said weft thread insertion channel during beat-up for positively locating an interlacing position for each weft thread.

2. The air jet weaving loom of claim 1, wherein said table surface (7') has a slightly downwardly sloping curve away from said flat top surface for spreading of said fabric.

* * * * *